US007748083B2

(12) United States Patent
Feinauer et al.

(10) Patent No.: US 7,748,083 B2
(45) Date of Patent: Jul. 6, 2010

(54) BUILT-IN DOMESTIC APPLIANCE

(75) Inventors: Adolf Feinauer, Giengen (DE); Bernd Heger, Haunsheim (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 11/794,215

(22) PCT Filed: Nov. 30, 2005

(86) PCT No.: PCT/EP2005/056345

§ 371 (c)(1),
(2), (4) Date: Jun. 21, 2007

(87) PCT Pub. No.: WO2006/069882

PCT Pub. Date: Jul. 6, 2006

(65) Prior Publication Data

US 2008/0000051 A1 Jan. 3, 2008

(30) Foreign Application Priority Data

Dec. 23, 2004 (DE) ..... 10 2004 062 235

(51) Int. Cl.
*E05D 11/10* (2006.01)

(52) U.S. Cl. ..... 16/319; 49/383; 200/61.7; 312/405

(58) Field of Classification Search ..... 16/371, 16/319, 374; 200/61.7, 61.62; 312/405; 49/26–28, 383
See application file for complete search history.

(56) References Cited

U.S. PATENT DOCUMENTS 853,507 A 5/1907 Fielding
3,231,880 A * 1/1966 Stein ..... 49/26
5,074,073 A * 12/1991 Zwebner ..... 49/26
5,265,954 A 11/1993 Keil
5,566,504 A * 10/1996 Pitel ..... 49/28
6,145,918 A * 11/2000 Wilbanks, II ..... 296/146.1
7,232,967 B2 * 6/2007 Rupp ..... 200/61.62
2003/0051314 A1 3/2003 Jenks (Continued)

FOREIGN PATENT DOCUMENTS

DE 44 18 238 11/1995

(Continued)

OTHER PUBLICATIONS

International Search Report PCT/EP2005/056345.

*Primary Examiner*—William L. Miller
(74) *Attorney, Agent, or Firm*—James E. Howard; Andre Pallapies

(57) ABSTRACT

A built-in domestic appliance including a hinge device that hinges a door to a furniture body of the built-in domestic appliance, with the hinge device being designed to implement an opening and closing movement of the door, during which a gap is formed between one edge of the door and a front of a second furniture body adjacent to the furniture body of the built-in domestic appliance, a sensor device that monitors the gap for a presence of a foreign body, and a blocking device that blocks the hinge device in the presence of the foreign body detected by the sensor device in a direction of movement of the door which would result in a further reduction of the gap.

12 Claims, 3 Drawing Sheets

U.S. PATENT DOCUMENTS

| | | | | |
|---|---|---|---|---|
| 2003/0213092 | A1* | 11/2003 | Fischbach et al. | 16/52 |
| 2004/0055110 | A1* | 3/2004 | Breed et al. | 16/82 |
| 2004/0206006 | A1* | 10/2004 | De La Coeur et al. | 49/383 |
| 2005/0029080 | A1 | 2/2005 | Rupp | |

FOREIGN PATENT DOCUMENTS

| | | |
|---|---|---|
| DE | 195 07 624 | 9/1996 |
| FR | 2 420 633 | 10/1979 |
| GB | 1 447 293 | 8/1976 |
| JP | 9-228733 | 9/1997 |

* cited by examiner

BUILT-IN DOMESTIC APPLIANCE

The invention relates to a built-in domestic appliance, particularly a built-in refrigerating apparatus which comprises hinges for hinging a door to the furniture body of the built-in domestic appliance. In addition, the invention relates to a method for operating the built-in domestic appliance.

BACKGROUND OF THE INVENTION

Such types of built-in domestic appliances having hinges are basically known according to the prior art. They are typically designed such that they implement a predefined opening and closing movement of the door relative to the furniture body. Particularly in the case of built-in domestic appliances for the US American market a gap forms between an in particular vertical edge of the door of the first furniture body and the front of a second furniture body adjacent to the first furniture body. This gap holds a considerable potential for danger for the user of the built-in domestic appliance because the user's limbs could possibly be crushed in the event of (accidental) encroachment into the gap. In the USA in particular, this potential for danger is associated with the risk of considerable claims for compensation for damages against the manufacturer of the built-in domestic appliance.

With regard to a quite similar problem, namely the danger of injury and in particular crushing of the limbs of a user of a built-in domestic appliance in the event of accidental encroachment into a hinge, a solution is known on the basis of the prior art, which is disclosed in the publication DE 44 18 238 A1. According to this publication, a cover which preferably isolates the hinge from any user encroachment during all possible pivoting movements is provided in the case of a multi-jointed hinge. This cover has an elastic plate element in the form of an elastic tongue which extends in the direction of the length of a gap between the door and the body of the built-in kitchen appliance, in other words typically in the vertical direction, but whose length or height is restricted to the height of the hinge.

SUMMARY OF THE INVENTION

The object of the invention is to use simple design measures to reduce the risk of injury, particularly of crushing, which is caused by an unavoidable gap between one edge of the door of the first furniture body and for example the front of a second furniture body adjacent to the first furniture body.

This object is achieved by the subject matter of the claims. The built-in domestic appliance described by this subject matter is characterized by a sensor device for monitoring the gap for foreign bodies and a blocking device for blocking the hinge device when the sensor device detects the presence of a foreign body in a direction of movement of the door which would result in a further reduction in the gap.

The claimed embodiment of the built-in domestic appliance having a sensor device in particular enables the detection of a foreign body for example in the form of limbs of a user of the furniture body or of the built-in domestic appliance in the gap. In addition, the claimed embodiment makes it possible to introduce suitable countermeasures in order to prevent or counteract any crushing of limbs. Such countermeasures are implemented with the aid of the claimed blocking device which either completely blocks the hinge device when the presence of a foreign body is detected, such that no further movement of the hinge and of the door attached to it is possible, or that only a movement of the door which would result in an enlargement of the gap is possible. In the latter case in particular the trapped foreign body can then be easily removed again from the gap. The claimed invention contributes not only significantly to reducing the risk of injury to the user but also advantageously significantly to a reduction in the risk of liability for the supplier or manufacturer of the furniture bodies or of the built-in domestic appliances.

Both electrical and also mechanical pressure sensor devices, which react to a force effect exerted on them by the foreign body in the gap and detect the foreign body in this manner, are advantageously suitable for use as sensor devices. As an alternative or in addition to being implemented as a pressure sensor device, the sensor device can also be implemented as a camera device or as a motion detector for optical detection of the foreign body in the gap.

An electrical or mechanical transmission facility is advantageously present between the sensor device and the blocking device in order to transmit and/or convey a trigger signal generated by the sensor device to the blocking device.

It can furthermore be advantageous if the blocking device acts not directly but indirectly by way of an auxiliary control facility on the hinge device and in particular its hinge elements.

Further advantageous embodiments of the hinge are set down in the subclaims.

The aforementioned object of the invention is furthermore achieved by a method for operating a built-in domestic appliance which comprises hinges for hinging a door to a furniture body. The advantages of this solution correspond to the advantages stated above with reference to the claimed built-in domestic appliance.

BRIEF DESCRIPTION OF THE DRAWINGS

The invention is accompanied by a total of three figures. In the drawings.

The invention will be described in detail in the following with reference to the aforementioned figures. The same elements are identified by the same reference characters in all the figures.

DETAILED DESCRIPTION OF THE EXEMPLARY EMBODIMENTS OF THE PRESENT INVENTION

Figure 1:
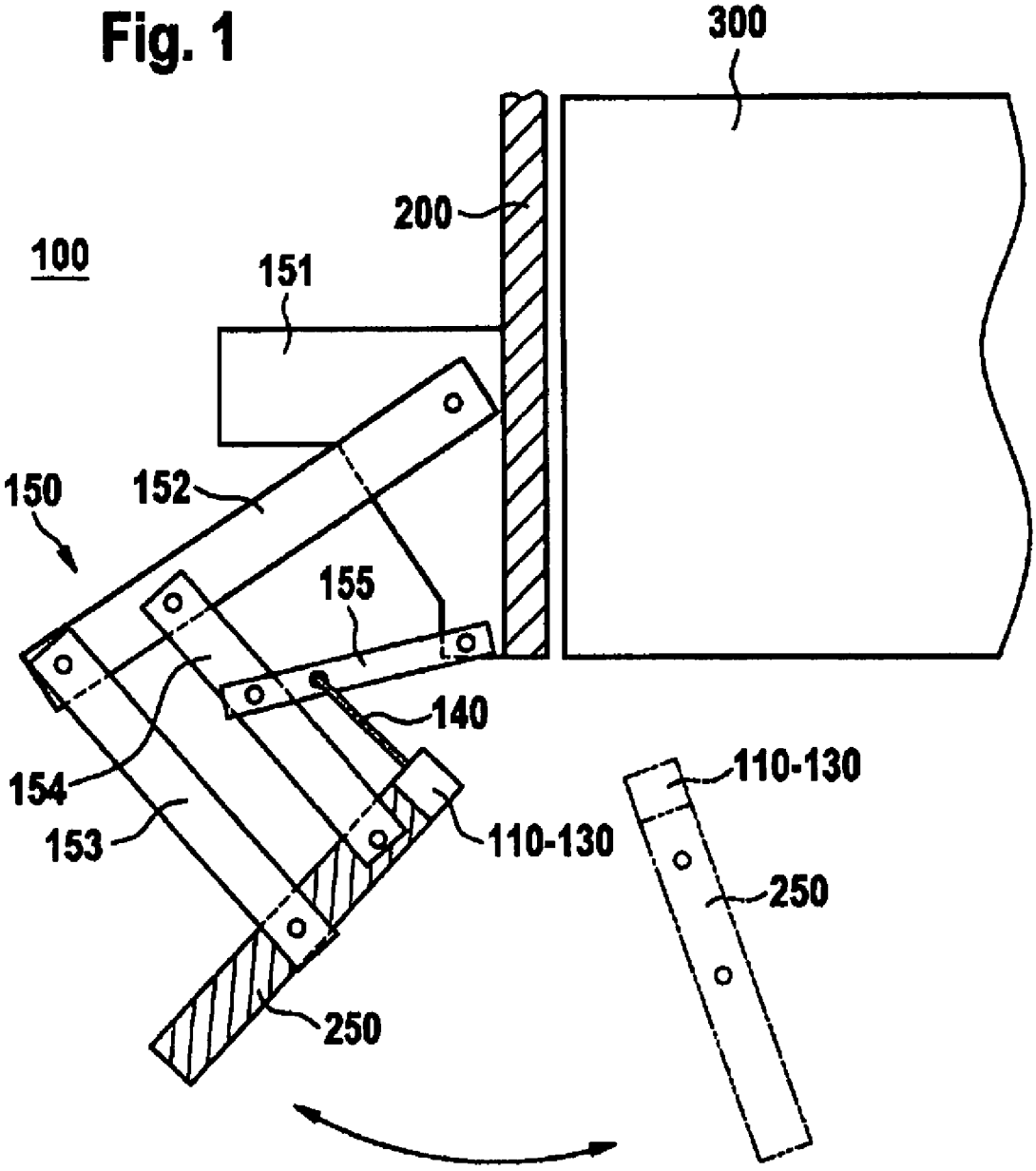
FIG. 1 shows a top view of an illustrated section of a built-in domestic appliance comprising a hinge mechanism

FIG. 1 shows a top view of the built-in domestic appliance 100 according to the invention. It comprises a hinge device 150 for hinging a door 250 to the furniture body 200 of the built-in domestic appliance implemented as a built-in refrigerating apparatus, of which only one side wall is drawn hatched in FIG. 1. The hinge device 150 comprises a plurality of hinge elements 151 . . . 155 which interact in such a manner as to implement a desired opening and closing movement of the door 250 with respect to the furniture body 200. With regard to this opening and closing movement, indicated by means of a double-headed arrow drawn in FIG. 1, particularly when the door 250 is opened wide a gap S is formed between one edge of the door 250 and for example the front of a second furniture body 300 adjacent to the first furniture body 200. This gap S holds a risk of injury inasmuch as foreign bodies, particularly limbs of a user of the furniture body or of the built-in domestic appliance, can become trapped or crushed in the gap when there is a movement of the door 250. On account of the risk of injury described, particularly in the USA the gap also holds a considerable risk of product liability and compensation for damages.

In order to avoid the risks described, the built-in domestic appliance 100 according to the invention additionally comprises a sensor device 110 for monitoring the gap S for the foreign body (see FIG. 3) and a blocking device 130 in order to block the hinge device 150 when a foreign body is detected by the sensor device 110 in the gap S. The blocking device 130 acts, as described, either directly or indirectly by way of an auxiliary control facility 140, in FIG. 1 for example a simple bar, on the hinge device 150, in FIG. 1 for example the hinge element 155.

Figure 2:
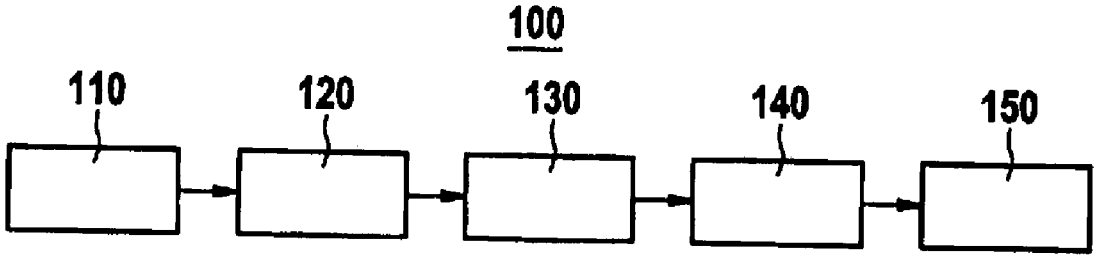
FIG. 2 shows the interaction of individual elements of the hinge mechanism.

FIG. 2 illustrates the inventive interaction of the individual components of the built-in domestic appliance 100, in other words the method according to the invention. The sensor device 110 monitors, as stated, the gap S for a foreign body 400. In response to the presence of the foreign body the sensor device 110 generates a trigger signal in order to trigger a blocking of the hinge device 150 by the blocking device 130. The trigger signal can be implemented in electrical or mechanical form, according to the implementation of the sensor device 110. A mechanically implemented trigger signal can for example be represented by the motion of a body. Depending on local circumstances and the implementation of the hinge in use with the built-in domestic appliance it can be advantageous if the trigger signal is transmitted not directly but by way of an electrical or mechanical transmission facility 120 to the blocking device 130. In the case of an electrical signal, the transmission facility 120 can for example be implemented in the form of an amplifier or relay and in the case of a mechanical trigger signal in the form of a bar or gearing.

Analogously, it can be advantageous depending on the installation situation and implementation of the hinge device 150 if the blocking device acts not directly but indirectly by way of the auxiliary control facility 140 on the hinge device 150 or its elements 151 . . . 155.

The blocking device 130 is designed according to the invention such that it prevents any injury to the foreign body 400, in other words particularly the trapping of limbs, in the gap S. Specifically, the blocking device 130 guarantees this by either completely blocking the movement of the hinge device 150 and thereby of the door 250 hinged to it or by only permitting a movement of the hinge device 150 in such a direction as would result in an enlargement of the gap S and thereby a release of any trapped foreign body.

Figure 3:
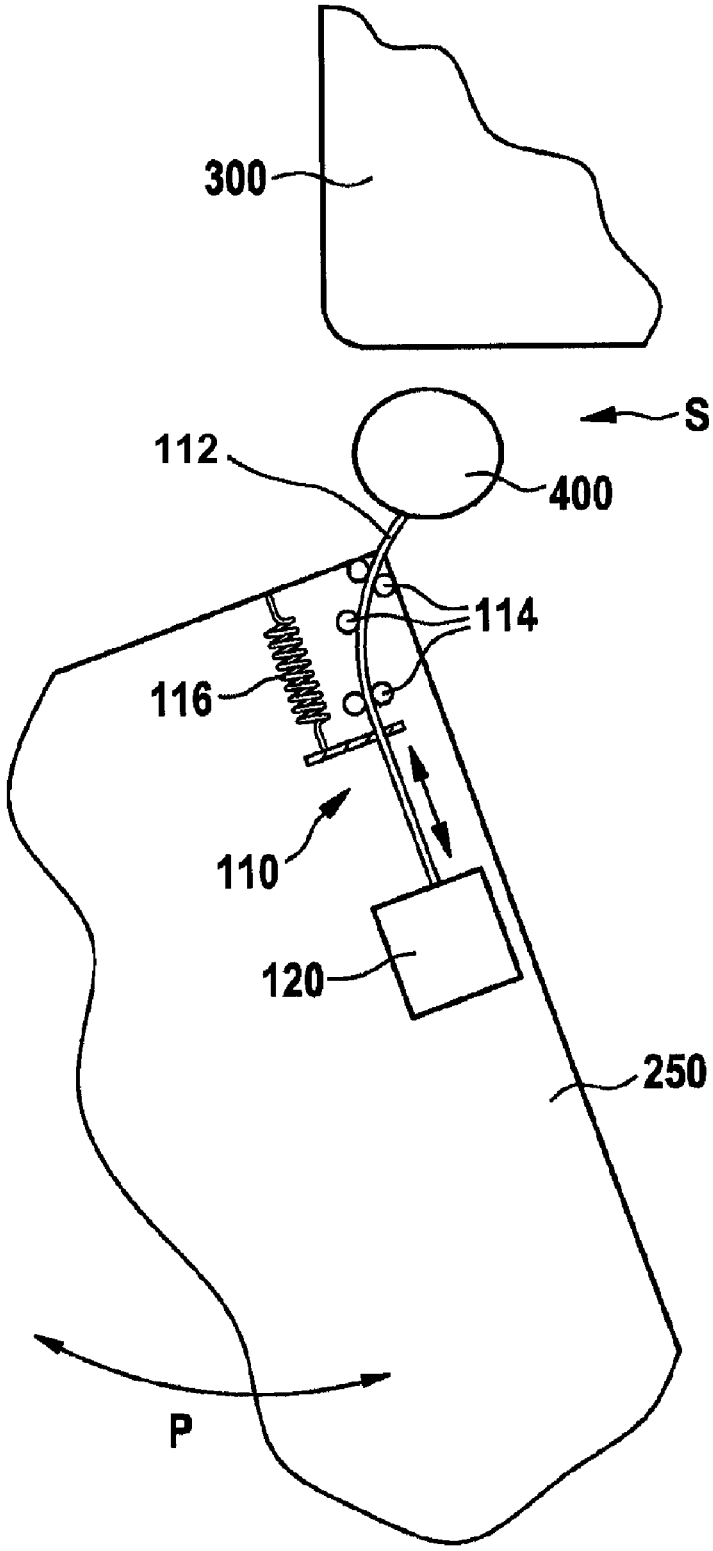
FIG. 3 shows an embodiment of the pressure sensor according to the invention.

FIG. 3 shows an example of the implementation of the sensor device 110 as a mechanical pressure sensor device. In this case the sensor device 110 consists of a force transmission element 112 which is formed for example as a bendable plate element. This force transmission element 112 is for example mounted so it can slide in the door 250 with the aid of a guiding device 114. It extends perpendicular to the drawing plane preferably over the entire length or height of the gap S and projects with one end into the latter. At its other end it has a non-positive coupling with the transmission facility 120 or a direct coupling with the blocking device 130. When the foreign body 400 is present in the gap S, in the event of a pivot movement of the door 250 in the arrow direction P it exerts a force on the end of the force transmission element 112 projecting to the gap S. This force is then preferably transmitted as a mechanical trigger signal, as already indicated above, either to the transmission facility 120 or directly to the blocking device 130. The blocking device 130 would then stop or reverse the movement of the door 250 in the arrow direction P in this case. As soon as the force acting on the force transmission element 112 decreases, whether it be either because the foreign body 400 has been removed from the gap or because the pivot movement of the door 250 has been reversed, the force transmission element is advantageously returned to its home position for example by means of a return spring 116, such that it once again projects into the gap S as a sensor if need be.

The invention claimed is:

1. A built-in domestic appliance comprising:

a hinge device that hinges a door to a furniture body of the built-in domestic appliance, with the hinge device being designed to implement an opening and closing movement of the door, during which a gap is formed between one edge of the door and a front of a second furniture body adjacent to the furniture body of the built-in domestic appliance;

a sensor device that monitors the gap for a presence of a foreign body and generates a trigger signal based on the monitored presence of the foreign body in the gap; and a blocking device that blocks the hinge device based directly or indirectly on the trigger signal generated by the sensor device based on the presence of the foreign body detected by the sensor device in a direction of movement of the door which would result in a further reduction of the gap.

2. The built-in domestic appliance as claimed in claim 1, wherein the sensor device includes a pressure sensor device for generating the trigger signal which indicates the presence of the foreign body when a pressure exerted by the foreign body on the pressure sensor device exceeds a predetermined pressure threshold value.

3. The built-in domestic appliance as claimed in claim 2, wherein the pressure sensor device includes a mechanical pressure sensor having a force transmission element, wherein at least a portion of the force transmission element projects into the gap, and wherein the force transmission element is mounted movably on or in the door in order to generate a mechanical trigger signal in a form of a movement of the force transmission element in response to a force effect on the force transmission element brought about by the foreign body in the gap.

4. The built-in domestic appliance as claimed in claim 2, wherein the pressure sensor device includes an electrical pressure sensor device for generating an electrical trigger signal.

5. The built-in domestic appliance as claimed in claim 2, further comprising a transmission facility for transmitting the trigger signal to the blocking device.

6. The built-in domestic appliance as claimed in claim 1, wherein the sensor device is one of a camera device and a motion detector that generates an electrical trigger signal in response to the presence of the foreign body in the gap.

7. The built-in domestic appliance as claimed in claim 1, wherein the hinge device has a plurality of movable hinge elements which interact in a suitable manner in order to implement the opening and closing movement of the door.

8. The built-in domestic appliance as claimed in claim 7, wherein the blocking device is implemented in order to limit a relative movement of one of the hinge elements with respect to another of the hinge elements or to the door or to one of the furniture body and the second furniture body by means of a direct or indirect action such that a movement of the door is either no longer possible or is only possible in a direction which would result in an enlargement of the gap.

9. The built-in domestic appliance as claimed in claim 8, further comprising an auxiliary control facility provided between the blocking device and at least one of the hinge elements for indirect control of the hinge element by the blocking device.

10. The built-in domestic appliance as claimed in claim 1, wherein the built-in domestic appliance includes a refrigerating apparatus.

11. A method of operating a built-in domestic appliance comprising a hinge device that hinges a door to a furniture body of the built-in domestic appliance, the method comprising:

pivoting the door by the hinge device such that a gap is formed between one edge of the door and a front of a second furniture body adjacent to the furniture body of the built-in domestic appliance;

monitoring the gap by a sensor device for a presence of a foreign body and generating a trigger signal based on the monitored presence of the foreign body in the gap; and blocking, by a blocking device, the hinge device based directly or indirectly on the trigger signal generated by the sensor device based on the presence of a detected foreign body from movement in a direction of movement of the door which would result in a further reduction of the gap.

12. A built-in domestic appliance comprising:

a hinge device that hinges a door to a furniture body of the built-in domestic appliance, the hinge device implementing an opening and closing movement of the door, during which a gap is formed between one edge of the door and a front of a second furniture body adjacent to the furniture body of the built-in domestic appliance;

a sensor device that monitors the gap between the one edge of the door and the front of the second furniture body adjacent to the furniture body of the built-in domestic appliance for a presence of a foreign body and generates a trigger signal based on the monitored presence of the foreign body in the gap; and a blocking device that one of directly and indirectly blocks a movement of the hinge device in a direction of movement of the door which would result in a further reduction of the gap, wherein the blocking device blocking the movement of the hinge device is triggered one of directly and indirectly by the trigger signal from the sensor device.

* * * * *